US006220167B1

(12) United States Patent
Yamamoto et al.

(10) Patent No.: US 6,220,167 B1
(45) Date of Patent: Apr. 24, 2001

(54) EXCAVATION METHOD BY BLASTING

(75) Inventors: Masaaki Yamamoto, Iruma-gun; Hidehiro Noda, Nobeoka; Koichi Sassa, Kyoto, all of (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 09/284,502

(22) PCT Filed: Nov. 4, 1997

(86) PCT No.: PCT/JP97/04001

§ 371 Date: Apr. 14, 1999

§ 102(e) Date: Apr. 14, 1999

(87) PCT Pub. No.: WO98/21544

PCT Pub. Date: May 22, 1998

(30) Foreign Application Priority Data

Nov. 12, 1996 (JP) ..... 8-300086
Apr. 30, 1997 (JP) ..... 9-112428

(51) Int. Cl.[7] ..... F42B 3/00
(52) U.S. Cl. ..... 102/312; 102/313
(58) Field of Search ..... 102/312, 313

(56) References Cited

U.S. PATENT DOCUMENTS 5,014,622 * 5/1991 Jullian ..... 102/313 X
5,359,935 * 11/1994 Willett ..... 102/313 X
5,388,521 * 2/1995 Coursen ..... 102/313 X
5,765,923 * 6/1998 Watson et al. ..... 102/313 X
5,811,741 * 9/1998 Coast et al. ..... 102/313 X

FOREIGN PATENT DOCUMENTS 1-285800 11/1989 (JP) .
4-165300 * 6/1992 (JP) ..... 102/312
7-122559 12/1995 (JP) .
8-14480 2/1996 (JP) .

OTHER PUBLICATIONS

PCT Preliminary Examiner Report, Jan. 20, 1998—PCT/JP97/04001.
PCT Search Report, Feb. 3, 1998—PCT/JP97/04001.

* cited by examiner

*Primary Examiner*—Peter A. Nelson
(74) *Attorney, Agent, or Firm*—Finnegan, Henderson, Farabow, Garrett & Dunner, L.L.P.

(57) ABSTRACT

The present invention relates to a blasting method which comprises conducting a delay blast at a particular location; predicting time series data of a waveform of ground vibration or noise at a remote location to be generated by a hypothetical single-hole blast at the particular location using at least one of previous time series data of a waveform of ground vibration or noise generated by said delay blast and actually monitored at the remote location, and the corresponding previous actually applied initiation time series of said delay blast; computing a delay blasting initiation time series for a delay blasting, which provides a waveform of ground vibration or noise satisfying specific conditions, based on the above-predicted time series data of a single-hole blast; and carrying out a subsequent delay blast according to the computed delay blasting initiation time series.

3 Claims, 5 Drawing Sheets

EXCAVATION METHOD BY BLASTING

TECHNICAL FIELD

The present invention relates to a blasting method capable of reducing ground vibration and noise generated upon blasting.

BACKGROUND ART

Conventionally, delay blasting methods using a delay detonator have been most advantageously employed to reduce ground vibration or noise effectively upon blasting. As methods for reducing ground vibration or noise more effectively, Japanese Patent Publication No. 122559/1995, Japanese Patent Application Laid-Open No. 285800/1989 and the like have proposed blasting methods using a detonator excellent in time accuracy which is controlled by integrated circuits, wherein dominant frequency or a waveform generated by a test single-hole blast is preliminarily monitored at a location where the ground vibration or noise becomes problematical and initiation intervals for a delay blast are determined based on the above-monitored dominant frequency or waveforms.

The waveforms of the ground vibration or noise generated by a blast are greatly influenced by the type of a target rock. In order to reduce ground vibration or noise generated by blasting a target rock most effectively according to the above methods, it is necessary to monitor dominant frequency or waveform of ground vibration or noise which is generated by a test single-hole blast at problematic locations every time before blasting a target rock.

Therefore, it is difficult to minimize ground vibration or noise constantly according to the conventional methods.

DISCLOSURE OF THE INVENTION

For avoiding the above drawback, the present invention provides a blasting method comprising conducting a delay blast at a particular location; predicting time series data of a waveform of ground vibration or noise at a remote location to be generated by a hypothetical single-hole blast at the particular location using at least one of previous time series data of a waveform of ground vibration or noise generated by said delay blast and actually monitored at the remote location, and the corresponding previous actually applied initiation time series of said delay blast; computing a delay blasting initiation time series for a delay blasting, which provides a waveform of ground vibration or noise satisfying specific conditions, based on the above-predicted time series data of a single-hole blast; and carrying out a subsequent delay blast according to the computed delay blasting initiation time series.

The present invention relates particularly to a blasting method comprising conducting a delay blast at the particular location; then computing the Fourier Transform of the time series data of a waveform of ground vibration or noise generated by said delay blast and actually monitored at the remote location, and the corresponding actually applied initiation time series data of said delay blast to obtain corresponding spectrums; predicting spectrums corresponding to time series data of a waveform of ground vibration or noise at a remote location to be generated by a hypothetical single-hole blast at the particular location using the corresponding spectrums obtained in the previous step; performing with the spectrums; computing the Inverse Fourier Transform of the performed spectrum; predicting time series data of a waveform of ground vibration or noise at the remote location to be generated by said hypothetical single-hole blast at the particular location; computing a delay blasting initiation time series for a delay blasting, which provides a waveform of ground vibration or noise satisfying specific conditions, based on the above-predicted time series data of a single-hole blast; and carrying out a subsequent delay blast according to the computed delay blasting initiation time series.

The present invention also relates particularly to a blasting method comprising conducting a delay blast at the particular location; then computing the cross-correlation sequence of time series data of a waveform of ground vibration or noise generated by said delay blast and actually monitored at a remote location, and the auto-correlation sequence of the corresponding actually applied initiation time series data of said delay blast; predicting time series data of a waveform of ground vibration or noise at a remote location to be generated by a hypothetical single-hole blast at the particular location, which most certainly seems to form the time series data of a waveform of ground vibration or noise of said delay blast, by solving Wiener's least squares theory according to the Levinson algorithm; computing a delay blasting initiation time series for a delay blasting, which provides a waveform of ground vibration or noise satisfying specific conditions, based on the above-predicted time series data of a single-hole blast; and carrying out a subsequent delay blast according to the computed delay blasting initiation time series.

It is possible to exemplify various methods for predicting time series data of a waveform of ground vibration or noise at a remote location, which is to be generated by a single-hole blast, using time series data of a waveform of ground vibration or noise generated by a delay blast at a particular location and the delay blasting initiation time series of said blast. The present invention may employ either a method which only uses the ground vibration or noise time series of a current delay blast, i.e,, a latest delay blast, and delay blasting initiation time series of said blast; or a method which uses the time series data of ground vibrations or noises of several previous delay blasts besides the current delay blast and delay blasting initiation time series of said previous blasts. In order to provide a clearer idea on the present invention, there will be described hereinafter several examples of the method which employs only the time series data of ground vibration or noise of a current delay blast and delay blasting initiation time series of said blast.

First of all, a successive analytical prediction method is described.

Defining the time series data of ground vibration or noise generated by a current delay blast at a particular location and a delay blasting initiation time series of the blast as $a_m$ and $\Delta_i$, respectively, the time series data $X_m$ of ground vibration or noise generated by a single-hole blast to be predicted can be successively computed as shown below. Both $a_m$ and $X_m$ indicate an $m^{th}$ data sampled under the conditions of a sampling interval of $\Delta_t$ and a number of samples of N. Accordingly, m falls within the range of $0 \leqq m \leqq N-1$. $\Delta_i$ is an integer obtained by dividing $i^{th}$ delay blast initiation time $T_i$ with $\Delta_t$. When the number of periods is defined as L, i falls within the range of $0 \leqq m \leqq L-1$. In this case, $\Delta_0$ indicates 0.

$$\Delta_0 \leqq t \leqq \Delta_1,\ X_t = \alpha_t$$

$$\Delta_1 \leqq t \leqq \Delta_2,\ X_t = \alpha_t - X_{(t-\Delta 1)}$$

$$\Delta_2 \leqq t \leqq \Delta_3,\ X_t = \alpha_t - X_{(t-\Delta 2)} - X_{(t-\Delta 2)}$$

$$\Delta_i \leqq t \leqq \Delta_{i+1},$$

$$X_t = a_t - \sum_{n=1}^{i} X_{(t-\Delta n)}$$

$$\Delta_{L-1} \leqq t \leqq N-1,$$

$$X_t = a_t - \sum_{n=1}^{L-1} X_{(t-\Delta n)}$$

Next, the Fourier Transform method is described.

Defining the time series data of ground vibration or noise generated at a particular location by a current delay blast as $A_{(t)}$, delay blast time series data of the blast as $\zeta_{(t)}$, and time series data of ground vibration or noise of a single-hole blast to be predicted as $X_{(t)}$, the following relationship is recognized among the three kinds of time series data.

$$A_{(t)} = \sum_{s=1}^{n} X_{(t-ts)} \cdot \zeta_{(ts)} = X_{(t)} * \zeta_{(t)}$$

()

Namely, the waveform $A_{(t)}$ derived from a delay blast is represented by a convolution of the waveforms $X_{(t)}$ of a single-hole blast and $\zeta_{(t)}$, wherein $t_0=0$ and $X_{(t)}=0$ when $t<0$.

Supposing, for example, the amplitude of each period is the same, $\zeta_{(t)}$ becomes 1 when an initiation timing t is $t_0$, $t_1$, . . . and $t_n$, and it becomes 0 when t is other than $t_0$, $t_1$, . . . or $t_n$.

Computing the Fourier Transform of the above equation:

$$A_{(f)}=X_{(f)}\cdot\zeta_{(f)} \text{(f: Frequency)}$$

Accordingly, $$X_{(f)}=A_{(f)}/\zeta_{(f)}$$

Since $A_{(f)}$ and $\zeta_{(f)}$ are known from $A_{(t)}$ and $\zeta_{(t)}$, $X_{(f)}$ is obtained. The next steps comprises computing Inverse Fourier Transform of the thus-obtained $X_{(f)}$ in order to transform $X_{(f)}$ from a frequency region to a time region and obtaining time series data $X_{(t)}$ of ground vibration or noise of a target single-hole blast to be predicted.

Next, the de-convolution method is described.

Defining the time series data of ground vibration or noise generated by a current delay blast at a particular location as $A_t$, ideal ground vibration or noise time series data obtained by eliminating errors of measurement and correlating deviation among each single-hole blast as $B_t$, delay blast initiation time series data of the blast as $\zeta_t$ (supposing the amplitude of each period is the same, $\zeta_t$ becomes 1 when an initiation timing t is $t_0$, $t_1$, . . . and $t_n$ and it becomes 0 when t is other than $t_0$, $t_1$, . . . or $t_n$), and time series data of ground vibration or noise of a single-hole blast to be predicted as $X_t$, the following relationship is recognized among the four kinds of time series data.

$$\sum_{s=0}^{m} X_s \cdot \zeta_{t-s} = X_t * \zeta_t = B_t \approx A_t$$

(* : Convolution)

If it is possible to compute $X_t$ so as to make the error between $A_t$ and $B_t$ minimum, the computed $X_t$ will be the ground vibration or noise data of a single-hole blast to be intended to obtain.

The ground vibration or noise data of a single-hole blast is obtained in accordance with the following method according to Wiener's least squares theory.

First, defining the energy of the error between $A_t$ and $B_t$ as E, the following equation can be established.

$$E = \sum_{t=0}^{n} (A_t - B_t)^2$$

Further, $$B_t = \sum_{s=0}^{m} X_s \cdot \zeta_{t-s}$$

Consequently, $$E = \sum_{t=0}^{n} \left( A_t - \sum_{s=0}^{m} X_s \cdot \zeta_{t-s} \right)^2$$

The energy of the error becomes minimum when $\partial E/\partial X_i=0$. Therefore, $$\partial E/\partial X_i = \partial \left\{ \left( \sum_{t=0}^{n} A_t \right) 2 - 2 \sum_{t=0}^{n} A_t \sum_{s=0}^{m} X_s \cdot \zeta_{t-s} + \sum_{t=0}^{n} \left( \sum_{s=0}^{m} X_s \cdot \zeta_{t-s} \right) 2 \right\} \Big/ \partial X_i$$

$$= -2 \sum_{t=0}^{n} A_t \zeta_{t-i} + 2 \sum_{t=0}^{n} \left( \sum_{s=0}^{m} X_s \cdot \zeta_{t-s} \right) \zeta_{t-i} = 0$$

Accordingly, $$\sum_{s=0}^{m} X_s \sum_{t=0}^{n} \zeta_{t-s} \zeta_{t-i} = \sum_{t=0}^{n} A_t \zeta_{t-i}$$

wherein $$\sum_{t=0}^{n} \zeta_{t-s} \zeta_{t-i} = \phi_{i-s}$$

($\phi$ : Auto-correlation function of $\zeta$)

$$\sum_{t=0}^{n} A_t \zeta_{t-i} = \psi_i$$

($\psi$ : Cross-correlation function of A and $\zeta$)

Consequently, $$\sum_{s=0}^{m} X_s \phi_{i-s} = \psi_i$$

The aimed waveform $X_t$ formed by a single-hole blast is computed by solving the above equation according to the Levinson algorithm.

In order, to make more precise predictions according to these methods, it is necessary to make a SN ratio of time series data obtained by a current delay blast at a particular location as good as possible using a displacement averaging, a band pass filtering and the like.

Further, there can be suggested several methods for computing, based on the above predicted data of a single-hole blast, a delay blasting initiation time series forming a waveform of ground vibration or noise of the delay blast which satisfies specific conditions. For example, there is exemplified a method disclosed in Japanese Patent Publication No. 122559/1995 wherein initiation time intervals are set based on the dominant frequency so as for a wave to interfere with each other; a method disclosed in Japanese Patent Application Laid-Open No. 285800/1989 wherein waveform of the blast is predicted based on the superposition theorem to select an optimum time interval; a method disclosed in Japanese Patent Publication No. 14480/1996 wherein M series is used; a method disclosed in the Journal of the Japan Explosives Society, NIPPON KAYAKU GAKKAI-SHI, vol. 55, no. 4, 1994 wherein auto-correlation and cross-correlation functions are used; and the like.

The specific conditions mean to minimize evaluated values such as displacement amplitude, displacement velocity amplitude, displacement acceleration amplitude, vibration level, vibration acceleration level or the like in the case of a wave, and to minimize evaluated values such as sound pressure amplitude, noise level or the like in the case of a noise. Sometimes, the specific conditions mean to minimize the above evaluated values in the specific range of frequency.

Once the delay blasting initiation time series is computed, a blast is effected according to the computed time series with a detonator excellent in time accuracy which is disclosed in, for example, Japanese Patent Application Laid-Open Nos. 261900/1987 and 285800/1989. The ground vibration or noise derived from the blast is monitored at a specific location, and re-employed together with the delay blasting initiation time series of the blast in order to predict time series data of the ground vibration or noise of a single-hole blast of the subsequent blast.

According to the blasting method of the present invention, the ground vibration or noise generated at a particular location upon a delay blasting can be controlled to a minimum without monitoring dominant frequency of the ground and a waveform of a single-hole blast at a location where ground vibration or noise becomes problematical prior to every blast.

BRIEF DESCRIPTION OF THE DRAWINGS

FIG. 3-1 shows a waveform of vertical ground vibration of a single-hole blast, which is predicted from the waveform shown in FIG. 1 according to a successive analytical prediction method described in the present invention.

FIG. 3-2 shows a waveform of vertical ground vibration of a single-hole blast, which is predicted from the waveform shown in FIG. 1 according to the Fourier Transform described in the present invention.

FIG. 3-3 shows a waveform of vertical ground vibration of a single-hole blast, which is predicted from the waveform shown in FIG. 1 according to the de-convolution method of the present invention.

FIG. 4-1 shows a computed waveform of vertical ground vibration at Location A when, using the waveform of FIG. 3-1, a two-period delay blast with an initiation interval of 120 ms is effected according to the linear superposition theorem.

FIG. 4-2 shows a computed waveform of vertical ground vibration at Location A when, using the waveform of FIG. 3-2, a two-period delay blast with an initiation interval of 120 ms is effected according to the linear superposition theorem.

FIG. 4-3 shows a computed waveform of vertical ground vibration at Location A when, using the waveform of FIG. 3-3, a two-period delay blast with an initiation interval of 120 ms is effected according to the linear superposition theorem.

FIG. 7-1 shows a waveform of vertical ground vibration of a single-hole blast, which is predicted from the waveform shown in FIG. 6 according to a successive analytical prediction method described in the present invention.

FIG. 7-2 shows a waveform of vertical ground vibration of a single-hole blast, which is predicted from the waveform shown in FIG. 6 according to the Fourier Transform described in the present invention.

FIG. 7-3 shows a waveform of vertical ground vibration of a single-hole blast, which is predicted from the waveform shown in FIG. 6 according to the de-convolution method of the present invention.

FIG. 8-1 shows a computed waveform of vertical ground vibration at Location A when, using the waveform of FIG. 7-1, a five-period delay blast with an initiation interval of 90 ms is effected according to the linear superposition theorem.

FIG. 8-2 shows a computed waveform of vertical ground vibration at Location A when, using the waveform of FIG. 7-2, a five-period delay blast with an initiation interval of 90 ms is effected according to the linear superposition theorem.

FIG. 8-3 shows a computed waveform of vertical ground vibration at Location A when, using the waveform of FIG. 7-3 a five-period delay blast with an initiation interval of 90 ms is effected according to the linear superposition theorem.

BEST MODE FOR CARRYING OUT THE INVENTION

Hereinafter, the blasting method of the present invention is illustrated in more detail with reference to Examples.

A plurality of primers, each of which consisted of an electronic delay detonator (trade name: EDD) with an opportunity set initiation timing and a water-gel explosive (100 g) (trade name: Sunvex), was placed at a depth of 2 meters near the center of a pond (longer side: 25 m, shorter side: 25 m, depth: 4 m) so that the distance of each primer may be about one meter, and then initiated. The ground vibration (normal direction X, tangent direction Y, vertical direction Z) was monitored at a location 100 meters away from the pond (hereinafter referred to as Location A) to confirm the effects of the present invention.

EXAMPLE 1

Figure 1:
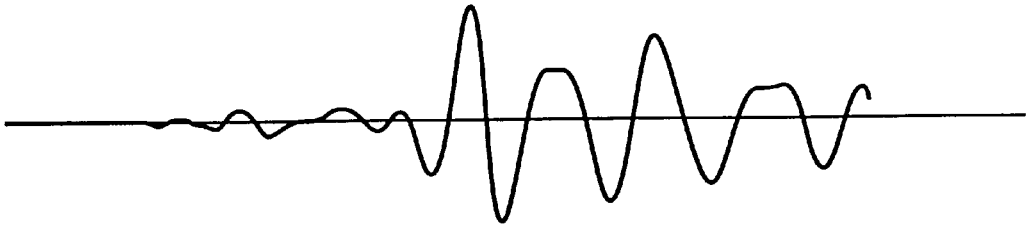
FIG. 1 shows a waveform of vertical ground vibration at Location A. The wave is produced by initiating two primers placed in water so as to have initiation timings of 10 ms and 40 ms, respectively, (i.e., an initiation time interval of 30 ms). Each of the primers consists of an electronic delay detonator and a water-gel explosive (100 g).

Two electronic delay detonators, whose initiation timings were set so as to be 10 ms and 40 ms, respectively (i.e., an initiation interval of 30 ms), were arranged individually in a water-gel explosive (100 g) and placed in water. The detonators were exploded to monitor ground vibration thereby produced at Location A. Among the monitored waveforms, the one derived from the vertical ground vibration is shown in FIG. 1. An. electronic delay detonator, whose initiation timing was set so as to be 10 ms, was arranged in a water-gel explosive (100 g) and placed in water. The detonator was exploded to monitor ground vibration thereby produced at Location A. Among the monitored waveforms, the one derived from the vertical ground vibration is shown in FIG. 2.

From the waveform shown in FIG. 1, a vertical waveform of a single-hole blast producing the waveform of FIG. 1 was predicted. The waveforms obtained by the successive analytical prediction method, Fourier Transform method and de-convolution method of the present invention are shown in FIGS. 3-1, 3-2 and 3-3, respectively.

Figure 2:
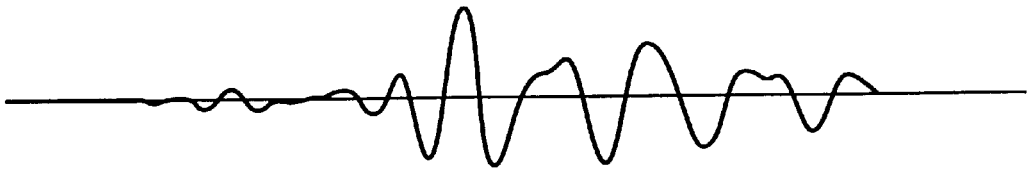
FIG. 2 shows a waveform of vertical ground vibration at Location A. The wave is produced by initiating a primer placed in water so as to have an initiation timing of 10 ms. The primer consists of an electronic delay detonator and a water-gel explosive (100 g).
Figures 1, 3:
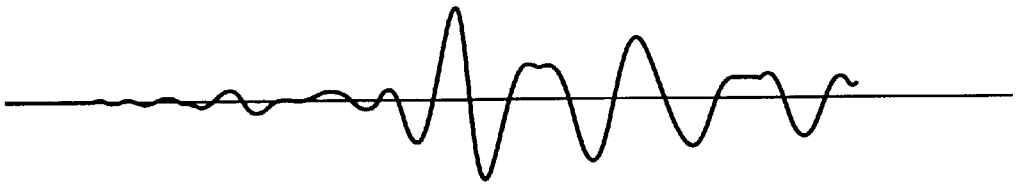
Figures 2, 3:
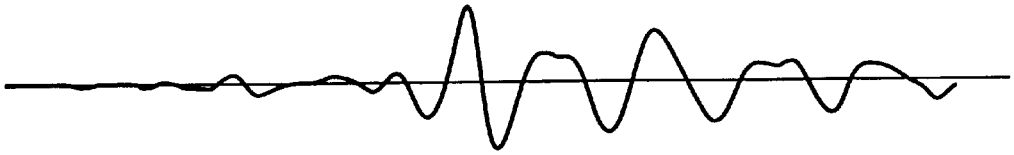
Figure 3:
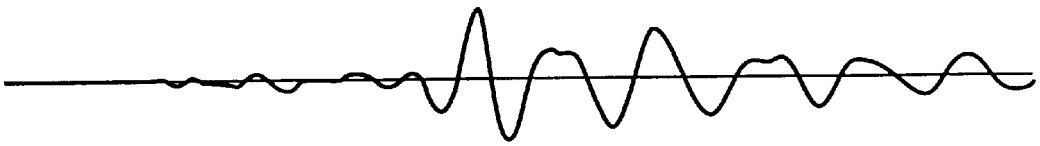
Figures 1, 4:
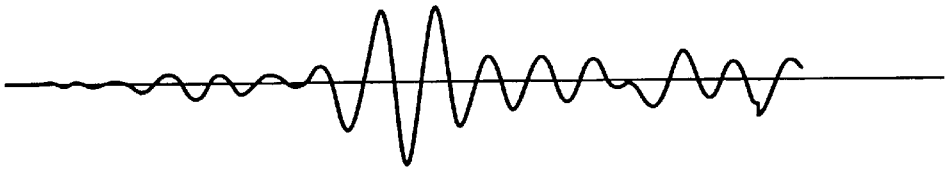
Figures 2, 4:
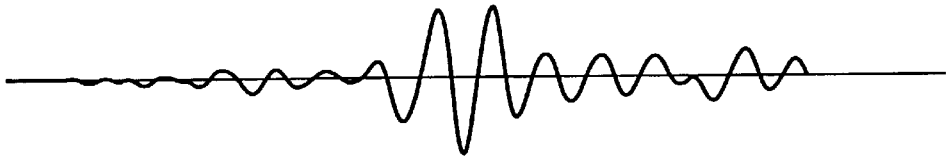
Figures 3, 4:
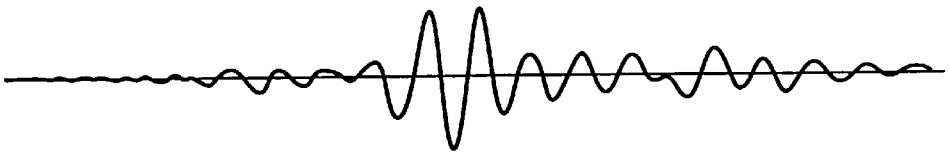

Based on the linear superposition theorem, vertical waveforms of the subsequent blasts of two-period delay blasts, whose initiation intervals were set variously, were predicted using the above-predicted waveforms (FIGS. 3-1, 3-2 and 3-3). As a result, the maximum displacement velocity amplitude of the vertical wave at Location A was minimized when the initiation interval was set at 120 ms. The predicted vertical waveforms of a two-period delay blast with an initiation interval of 120 ms, which were obtained according to the successive analytical prediction method, Fourier Transform method and de-convolution method of the present invention, are shown in FIGS. 4-1, 4-2 and 4-3, respectively.

In view of the above prediction, two electronic delay detonators, whose initiation timings were set at 10 ms and 130 ms, respectively (i.e., an initiation interval of 120 ms), were arranged individually in a water-gel explosive (100 g) and placed in water. The detonators were exploded to monitor ground vibration thereby produced at Location A. Among the monitored waveforms, the one derived from the vertical ground vibration is shown in FIG. 5.

Among the thus-obtained nine kinds of waveforms, the waveform shown in FIG. 2, which was derived from a single-hole blast, and the waveforms of a single-hole blast shown in FIGS. 3-1, 3-2 and 3-3, which were predicted according to the successive analytical prediction method, the Fourier Transform method and the de-convolution method, were compared. As a result, it was found that these waveforms were very similar and the successive analytical prediction method, the Fourier Transform method and the de-convolution method were all advantageous in predicting waveforms derived from a two-period delay blast. When the similarity of these waveforms was evaluated according to cross-correlation coefficient, the correlation coefficients of FIG. 2 and FIGS. 3-1, 3-2 and 3-3 were 0.88, 0.93 and 0.96, respectively. These results mean that the waveforms are similar in quantity, too.

Figure 5:
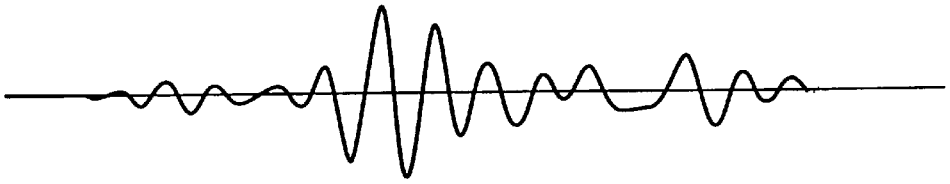
FIG. 5 shows a waveform of vertical ground vibration at Location A. The wave is produced by initiating two primers placed in water so as to have initiation timings of 10 ms and 130 ms, respectively (i.e., an initiation interval of 120 ms). Each of the primers consists of an electronic delay detonator and a water-gel explosive (100 g).

Comparing the waveforms of a two-period delay blast shown in FIGS. 4-1, 4-2 and 4-3, which were predicted at Location A based on the linear superposition theorem when a two-period delay blast was exploded with an initiation interval of 120 ms using the waveforms of a single-hole blast predicted according to the successive analytical prediction method, the Fourier Transform method and the de-convolution method, with the waveform of the vertical ground vibration shown in FIG. 5, those waveforms also very much resembled each other. The correlation coefficients of FIGS. 4-1, 4-2 and 4-3 and FIG. 5 were 0.92, 0.92 and 0.91, respectively.

EXAMPLE 2

Five electronic delay detonators, whose initiation timings were set so as to be 10 ms, 40 ms, 70 ms, 100 ms and 130 ms, respectively (i.e., an initiation interval of 30 ms), were arranged individually in a water-gel explosive (100 g) and placed in water. The detonators were exploded to monitor ground vibration thereby produced at Location A. Among the monitored waveforms, the one derived from the vertical ground vibration is shown in FIG. 6.

Figure 6:
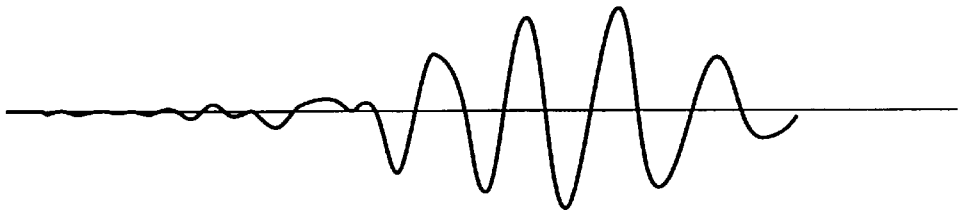
FIG. 6 shows a waveform of vertical grounds vibration at Location A. The wave is produced by initiating five primers placed in water so as to have initiation timings of 10 ms, 40 ms, 70 ms, 100 ms and 130 ms, respectively (i.e., initiation intervals of 30 ms). Each of the primers consists of an electronic delay detonator and a water-gel explosive (100 g).
Figures 1, 7:
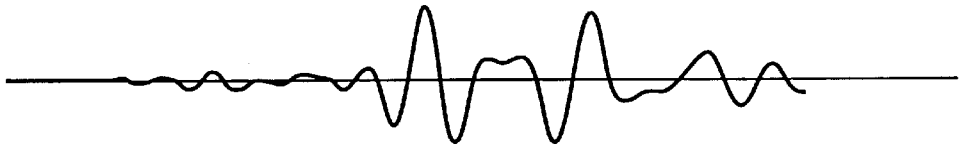
Figures 2, 7:
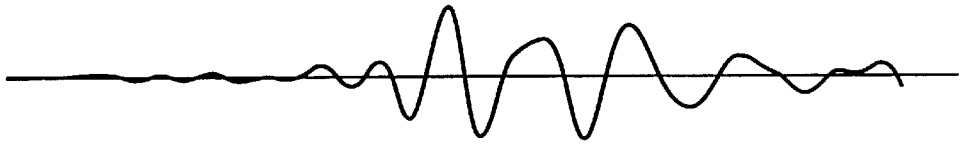
Figures 3, 7:
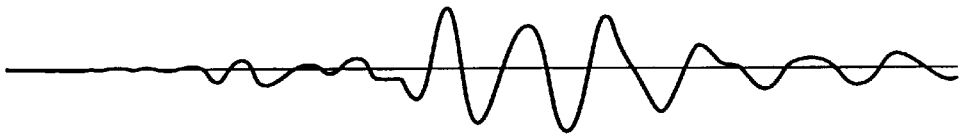
Figures 1, 8:
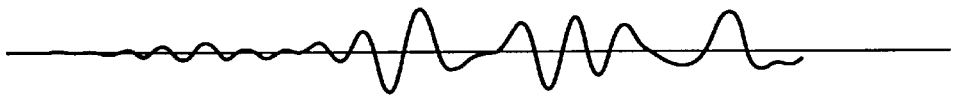
Figures 2, 8:
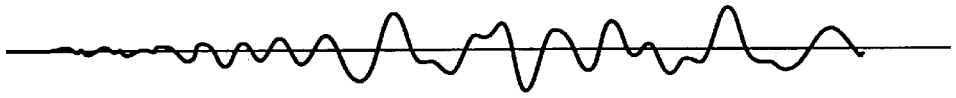
Figures 3, 8:
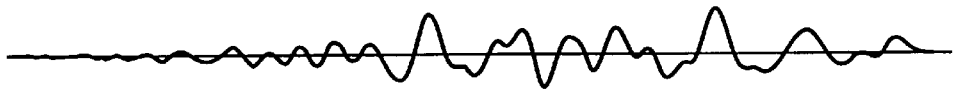

From the waveform shown in FIG. 6, a vertical waveform of a single-hole blast producing the waveform of FIG. 6 was predicted. The waveforms obtained by the successive analytical prediction method, Fourier Transform method and de-convolution method of the present invention are shown in FIGS. 7-1, 7-2 and 7-3, respectively.

Based on the linear superposition theorem, vertical waveforms of the subsequent blasts of five-period delay blasts, whose initiation intervals were set variously, were predicted using the above-predicted waveforms (FIGS. 7-1, 7-2 and 7-3). As a result, the maximum displacement velocity amplitude of the vertical wave at Location A was minimized when the initiation interval was set at 90 ms. The predicted vertical waveforms of a five-period delay blast with an initiation interval of 90 ms, which were obtained according to the successive analytical prediction method, Fourier Transform method and de-convolution method of the present invention, are shown in FIGS. 8-1, 8-2 and 8-3, respectively.

In view of the above prediction, five electronic delay detonators, whose initiation timings were set at 10 ms, 100 ms, 190 ms, 280 ms and 370 ms, respectively (i.e., an initiation interval of 90 ms), were arranged individually in a water-gel explosive (100 g) and placed in water. The detonators were exploded to monitor ground vibration thereby produced at Location A. Among the monitored waveforms, the one derived from the vertical ground vibration is shown in FIG. 9.

The waveform shown in FIG. 2, which was derived from a single-hole blast, was compared with the waveforms shown in FIGS. 7-1, 7-2 and 7-3, which were predicted according to the successive analytical prediction method, the Fourier Transform method and the de-convolution method. As a result, it was found that the waveforms very much resembled each other as well as the comparison with those derived from a five-period delay blast. This means that the successive analytical prediction method, the Fourier Transform method and the de-convolution method are always useful to predict a waveform of a single-hole blast. The correlation coefficients of FIGS. 7-1, 7-2 and 7-3 and FIG. 2 were 0.92, 0.96 and 0.93, respectively.

Figure 9:
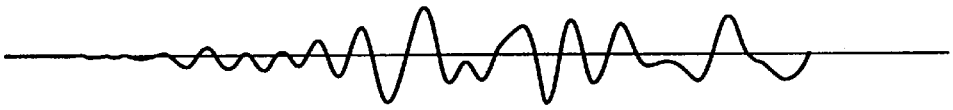
FIG. 9 shows a waveform of vertical ground vibration at Location A. The wave is produce by initiating five primers which are placed in water so as to have initiation timings of 10 ms, 100 ms, 190 ms, 280 ms and 370 ms, respectively (i.e., initiation intervals of 90 ms). Each of the primers consists of an electronic delay detonator and a water-gel explosive (100 g).

Comparing the waveforms of a five-period delay blast shown in FIGS. 8-1, 8-2 and 8-3, which were predicted at Location A based on the linear superposition theorem when a five-period delay blast was exploded with an initiation interval of 90 ms using the waveforms of a single-hole blast predicted according to the successive analytical prediction method, the Fourier Transform method and the de-convolution method, with the waveform of the vertical ground vibration shown in FIG. 9, those waveforms also very much resembled each other. The correlation coefficients of FIGS. 8-1, 8-2 and 8-3 and FIG. 9 were 0.86, 0.90 and 0.89, respectively.

Industrial Applicability

The blasting method of the present invention is useful to reduce the ground vibration and noise generated upon blasting.

What is claimed is:

1. A blasting method which comprises conducting a delay blast at a particular location; predicting time series data of a waveform of ground vibration or noise at a remote location to be generated by a hypothetical single-hole blast at the particular location using at least one of previous time series data of a waveform of ground vibration or noise generated by said delay blast and actually monitored at the remote location, and the corresponding previous actually applied initiation time series of said delay blast; computing a delay blasting initiation time series for a delay blasting, which provides a waveform of ground vibration or noise satisfying specific conditions, based on the above-predicted time series data of a single-hole blast; and carrying out a subsequent delay blast according to the computed delay blasting initiation time series.

2. A blasting method according to claim 1, wherein time series data of a waveform of ground vibration or noise at a remote location to be generated by a hypothetical single-hole blast at the particular location is predicted by conducting a delay blast at the particular location; then computing the Fourier Transform of the time series data of a waveform of ground vibration or noise generated by said delay blast and actually monitored at the remote location, and the corresponding actually applied initiation time series data of said delay blast to obtain corresponding spectrums; performing with the spectrums; and computing the Inverse Fourier Transform of the performed spectrum.

3. A blasting method according to claim 1, wherein time series data of a waveform of ground vibration or noise at a remote location to be generated by a hypothetical single-hole blast at the particular location is predicted by conducting a delay blast at the particular location; and then computing the cross-correlation sequence of time series data of a waveform of ground vibration or noise generated by said delay blast and actually monitored at a remote location, and the auto-correlation sequence of the corresponding actually applied initiation time series data of said delay blast.

* * * * *